US010560795B1

(12) United States Patent
Kim

(10) Patent No.: US 10,560,795 B1
(45) Date of Patent: Feb. 11, 2020

(54) FORMING METHOD FOR PERSONALIZED ACOUSTIC SPACE CONSIDERING CHARACTERISTICS OF SPEAKERS AND FORMING SYSTEM THEREOF

(71) Applicant: SQAND Co. Ltd., Daejeon (KR)

(72) Inventor: Yang-Hann Kim, Daejeon (KR)

(73) Assignee: SQAND CO. LTD., Daejeon (KR)

( * ) Notice: Subject to any disclaimer, the term of this patent is extended or adjusted under 35 U.S.C. 154(b) by 0 days.

(21) Appl. No.: 16/210,458

(22) Filed: Dec. 5, 2018

(30) Foreign Application Priority Data

Oct. 26, 2018 (KR) ..... 10-2018-0128726

(51) Int. Cl.

| | |
|---|---|
| ***H04S 7/00*** | (2006.01) |
| ***H04R 5/02*** | (2006.01) |
| ***H04R 5/04*** | (2006.01) |
| ***H04R 3/04*** | (2006.01) |
| ***H04S 3/00*** | (2006.01) |

(52) U.S. Cl.
CPC ..... *H04S 7/303* (2013.01); *H04R 3/04* (2013.01); *H04R 5/02* (2013.01); *H04R 5/04* (2013.01); *H04S 3/008* (2013.01); *H04R 2499/13* (2013.01); *H04S 2400/01* (2013.01)

(58) Field of Classification Search
CPC ..... H04R 5/02; H04R 5/04; H04R 2499/13; H04R 3/04; H04S 7/303; H04S 2400/01; H04S 3/008
USPC ..... 381/303
See application file for complete search history.

(56) References Cited

U.S. PATENT DOCUMENTS

| | | | | |
|---|---|---|---|---|
| 9,392,390 | B2 * | 7/2016 | Olsen | H04S 7/30 |
| 2014/0348354 | A1 | 11/2014 | Christoph et al. | |

FOREIGN PATENT DOCUMENTS

| | | | |
|---|---|---|---|
| JP | 2008011342 | A | 1/2008 |
| JP | 2009124395 | A | 6/2009 |
| KR | 1020100066826 | A | 6/2010 |
| KR | 20140138907 | A | 12/2014 |
| KR | 1020140138907 | A | 12/2014 |
| WO | 2013105413 | A1 | 7/2013 |
| WO | 2017178454 | A1 | 10/2017 |

* cited by examiner

*Primary Examiner* — Paul Kim
(74) *Attorney, Agent, or Firm* — McCoy Russell LLP

(57) ABSTRACT

Provided are a forming method for a personalized sound zone and a forming system thereof. Using The forming method for a personalized sound zone, by calculating a control filter reflecting the characteristics of individual speakers, a numerical error and resultant occurrence of noise may be reduced when the filter is calculated, and an effective personalized sound zone may be formed only with directivity without a control filter at a frequency band in which sound between seats are separable according to distances.

14 Claims, 10 Drawing Sheets

FORMING METHOD FOR PERSONALIZED ACOUSTIC SPACE CONSIDERING CHARACTERISTICS OF SPEAKERS AND FORMING SYSTEM THEREOF

CROSS-REFERENCE TO RELATED APPLICATIONS

This application claims priority under 35 U.S.C. § 119 to Korean Patent Application No. 10-2018-0128726, filed on Oct. 26, 2018, in the Korean Intellectual Property Office, the disclosure of which is incorporated herein by reference in its entirety.

TECHNICAL FIELD

The following disclosure relates to a forming method for a personalized sound zone in a space and a forming system for a personalized sound zone, and more particularly, to a method for forming a personalized sound zone in consideration of acoustic characteristics of individual speakers arranged in a space, and a forming system thereof.

BACKGROUND

A method for controlling sound in a space includes an sound field reproducing method of reproducing a specific sound field, an active noise control method of reducing a magnitude of sound of a space using a plurality of active sound sources, a method of changing an interval between sound sources arranged in a specific form, a method of increasing acoustic power radiated at a specific angle by changing time delay between sound sources and a magnitude of each sound source, and the like. Recently, research on personalized sound zone control has actively been conducted to deliver only a specific sound source according to positions of a listener in a closed space such as the inside of a vehicle compartment or a living room.

For example, Korean Patent Laid-Open Publication No. 10-2010-0066826 (Directional Sound Generating Apparatus and Method) proposes a method of radiating sound to a specific region but discloses only a technique of concentrating sound to a specific region by disposing a high-directive speaker and the like. In this manner, the related art method of controlling sound of a space using a plurality of sound sources merely changes time delay between sound sources and an input magnitude thereof and merely changes only a direction of sound sources using a sound source arrangement in a limited form, without considering a position of a listener in a predetermined space.

Meanwhile, Korean Patent Laid-Open Publication No. 10-2014-0138907 (Method of Applying Integrated or Hybrid Sound-Field Control Strategy) discloses a method of applying an integrated control strategy for regeneration of multi-channel audio signals in two or more sound zones but all the speakers in use are limited to have the same acoustic characteristics. However, in the case of calculating an acoustic transfer function on the assumption that all the speakers in use have the same acoustic characteristics, even a speaker which contributes less to form an actual personalized sound zone is forcibly excited or a speaker is forcibly excited even at a frequency band having a low contribution to form a personalized sound zone, and thus, there is a high possibility of including a numerical error and it is not desirable in terms of efficiency such as the amount of calculation for calculating a control filter, and the like.

In particular, inside a vehicle compartment in which speakers having a variety of acoustic characteristics to form an optimal acoustic environment such as a tweeter for a high range, a mid-woofer or a full-range for a mid-part, a sub-woofer for a low range, and the like, are combined to be used, a contribution of each speaker appears to be different in forming a personalized sound zone in a specific zone, and thus it is more important to consider acoustic characteristics of the individual speakers. Further, in the case of the related art personalized sound zone control, a control filter is calculated on the assumption that such a contribution is regarded to be included in a acoustic transfer function between a speaker and a microphone positioned in a set zone or all the speakers have the same characteristics, and in this control method, a speaker with little contribution may be utilized in calculating the control filter in a frequency region with a low contribution to act as a sort of numerical error and an acoustic signal, although weak, is discharged when actually forming an sound field and heard as noise.

RELATED ART DOCUMENT

Patent Document

Korean Patent Laid-Open Publication No. 10-2010-0066826 (published on Jun. 18, 2010)

Korean Patent Laid-Open Publication No. 10-2014-0138907 (published on Dec. 4, 2014)

SUMMARY

An embodiment of the present invention is directed to providing a forming method for a personalized sound zone and a forming system thereof, capable of reducing generation of noise according to a numerical error in consideration of acoustic characteristics of individual speakers in forming a personalized sound zone in space, and increasing calculation efficiency.

Another embodiment of the present invention is directed to providing a forming method for a personalized sound zone and a forming system thereof, capable of reducing the amount of calculation in calculating a control filter by selecting whether to apply a filter according to contributions per frequency band in considering acoustic characteristics of individual speakers.

Another embodiment of the present invention is directed to providing a forming method for a personalized sound zone and a forming system thereof, capable of calculating a control filter by reflecting a set equalizer value adjusted by a user in considering acoustic characteristics of individual speakers.

In one general aspect, a personalized sound zone forming method for forming a personalized sound zone to transfer individual sound sources to a plurality of listening positions in a space, includes: extracting characteristics of a plurality of speakers arranged in a space; extracting an acoustic transfer function between the plurality of speakers arranged in the space and the plurality of listening positions; extracting a correction function according to the characteristics of the individual speakers; extracting a correction acoustic transfer function according to the extracted correction function; configuring a price function for forming a personalized sound zone using the extracted acoustic transfer function and deriving an optimal value; and calculating a control filter according to the derived optimal value.

In the extracting of a correction function, the correction function may be calculated according to frequency characteristics of the individual speakers.

The correction function may be calculated according to a contribution of the individual speakers at each frequency band.

The extracting of a correction function may further include calculating a distance to the listening positions where a personalized sound zone is formed with the plurality of speakers.

The correction function may be calculated according to the contribution of the individual speakers at each frequency band according to the listening positions where a personalized sound zone is formed.

The personalized sound zone forming method may further include receiving a weighting value for each frequency band set through an audio equalizer, wherein, in the extracting of the correction function, the correction function may be calculated according to the frequency characteristics of the individual speakers and the weighting value for each frequency band set through the audio equalizer.

In another general aspect, a personalized sound zone forming method for forming a personalized sound zone to transfer individual sound sources to a plurality of listening positions in a space, includes: extracting characteristics of a plurality of speakers arranged in a space; extracting an acoustic transfer function between the plurality of speakers arranged in the space and the plurality of listening positions; configuring a price function for forming a personalized sound zone using the extracted acoustic transfer function and deriving an optimal value; calculating a control filter according to the derived optimal value; calculating a contribution to a personalized sound zone at each frequency band according to sound sources; and outputting sound according to the calculated control filter and the contribution of the sound sources at each frequency band.

In the calculating of a contribution at each frequency band, a frequency band having a high contribution and a frequency band having a low contribution in forming a personalized sound zone may be separated according to the sound sources, and in the outputting of sound, the calculated control filter may be applied to the frequency band having the high contribution and may not be applied to the frequency band having the low contribution.

In the outputting of sound, a sound source signal to which the control filter is applied and a sound source signal to which the control filter is not applied according to the contribution may be added to be output.

In the outputting of sound, the sound source of the frequency band having the high contribution may be output to the speaker through an amplifier after the calculated control filter is applied thereto, and the sound source of the frequency band having the low contribution may be directly output to the speaker, without applying the control filter thereto and without passing through the amplifier.

In another general aspect, a personalized sound zone forming system for forming a personalized sound zone to supply different sound sources to a plurality of listening positions in a space, includes: a sound source generating unit supplying a plurality of sound sources; a controller calculating a control filter for forming a personalized sound zone; and a sound source output unit outputting a sound source to a personalized sound zone, wherein the sound source output unit includes a plurality of speakers and the control filter is calculated to reflect characteristics of the individual speakers.

The sound source output unit may include a combination of a plurality of speakers having different frequency characteristics, and the control filter may be calculated to reflect the characteristics of the individual speakers.

The control filter may be calculated to reflect a contribution of the individual speakers at each frequency band.

The control filter may be calculated to reflect the contribution of the individual speakers at each frequency band with respect to a distance to the listening positions where a personalized sound zone is formed with the plurality of speakers and a distance to the listening positions where the personalized sound zone is formed.

The personalized sound zone forming system may further include: an audio equalizer setting different weighting values for each frequency band, wherein the control filter is calculated according to frequency characteristics of the individual speakers and the weighting values for each frequency band set through the audio equalizer.

The controller may separate a frequency band having a high contribution and a frequency band having a low contribution in forming a personalized sound zone according to the sound sources, and apply the calculated control filter to the frequency band having the high contribution and may not apply the control filter to the frequency band having the low contribution.

The sound source output unit may add a sound source signal to which the control filter is applied and a sound source signal to which the control filter is not applied according to the contribution, and output the same.

The sound source output unit may output the sound source of the frequency band having the high contribution to the speaker through an amplifier after applying the calculated control filter thereto, and directly output the sound source of the frequency band having the low contribution to the speaker, without applying the control filter thereto and without passing through the amplifier.

Other features and aspects will be apparent from the following detailed description, the drawings, and the claims.

DETAILED DESCRIPTION OF EMBODIMENTS

The advantages, features and aspects of the present invention will become apparent from the following description of the embodiments with reference to the accompanying drawings, which is set forth hereinafter. The present invention may, however, be embodied in different forms and should not be construed as limited to the embodiments set forth herein. Rather, these embodiments are provided so that this disclosure will be thorough and complete, and will fully convey the scope of the present invention to those skilled in the art. The terminology used herein is for the purpose of describing particular embodiments only and is not intended to be limiting the embodiments. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Hereinafter, a forming method for a personalized sound zone according to the present invention having the above-described solution will be described in detail with reference to the accompanying drawings.

Figure 1:
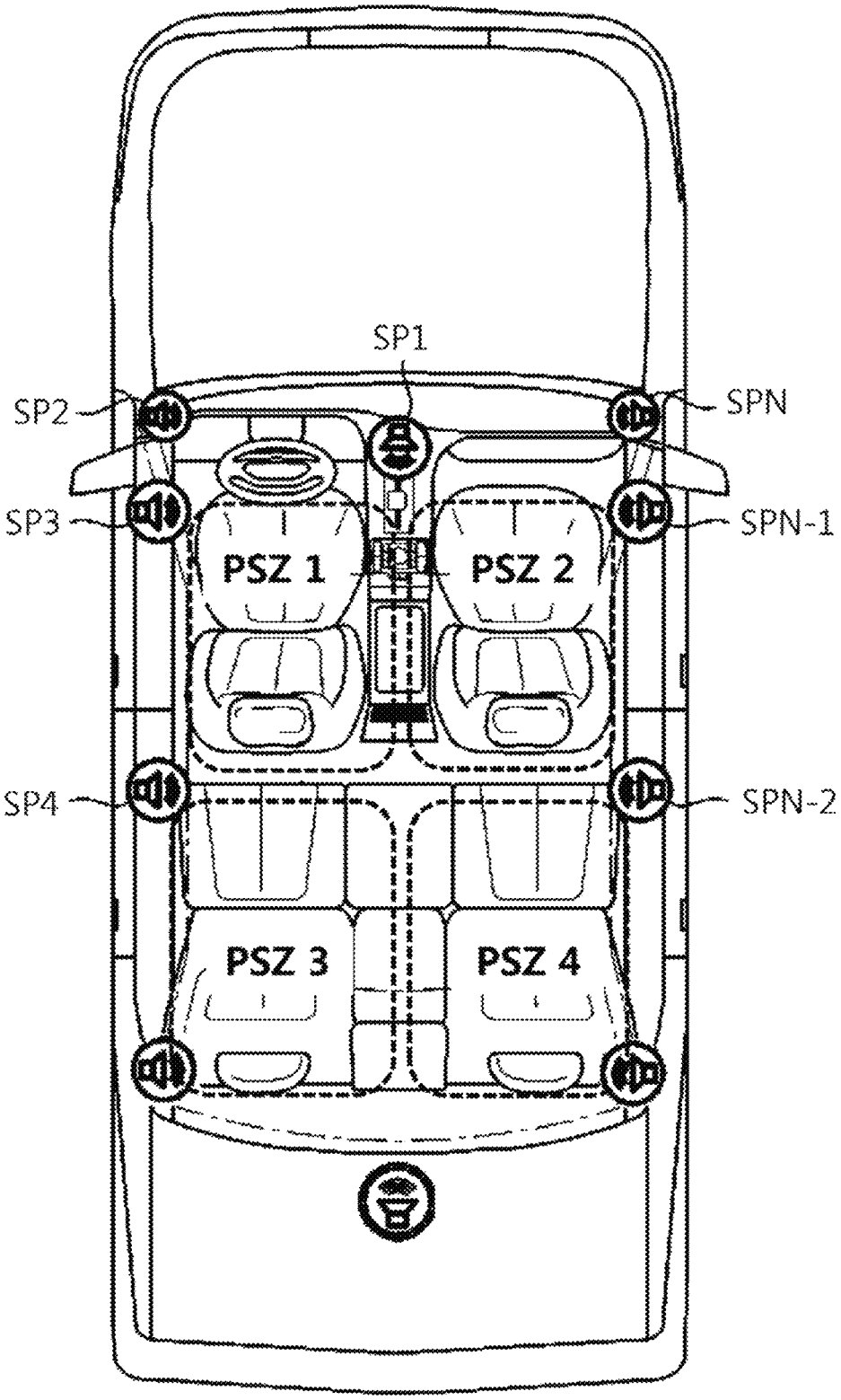
FIG. 1 is a view illustrating personalized sound zones formed in a vehicle.

FIG. 1 is a diagram for explaining a personalized sound zone formed in a vehicle, in which a plurality of personalized sound zones (or a plurality of personalized sound zones (PSZ)) are formed in one space. As illustrated in FIG. 1, a first speaker SP1, a second speaker SP2, and an N-th speaker SPN are dispersed at various positions in the vehicle. In order to transmit optimal sound to users located in a vehicle compartment using the plurality of speakers, a personalized sound zone may be formed at each seat position. For example, FIG. 1 illustrates four personalized sound zones PSZ1, PSZ2, PSZ3, and PSZ4 formed in the driver's seat, a passenger's seat, and back seats, respectively. Of course, this is merely an example, and the number and positions of the personalized sound zones may be set as necessary. In the example of FIG. 1, it may be easily inferred that the personalized sound zone PSZ1 will mainly be formed by sound sources output from SP1, SP2, SP3, and SP4 in the case of a user who sits on the driver's seat. However, the plurality of speakers are generally configured to have different frequency characteristics. That is, one speaker may be configured as a mid-range speaker and another speaker may be configured as a low-range speaker. Here, for example, in the example of FIG. 1, it is assumed that the front speakers SP1, SP2, SP3, SPN-1, and SPN are configured as mid-range speakers and the rear speakers SP4 and SPN-2 are configured as low-range speakers. When a sound source the user who sits on the driver's seat may listen to is a sound source in which a low range is strong, the speaker SP4 is a low-range speaker, and thus, the speaker SP4 may smoothly output a low-range sound source, but the speakers SP1, SP2, and SP3 are mid-range speakers, and thus, the speakers SP1, SP2, and SP3 may not be able to smoothly regenerate the low-range sound source due to a limitation of performance. If the speakers SP1, SP2, SP3, and SP4 are all controlled using the same control filter, excessive forced excitation occurs in the speakers SP1, SP2, and SP3, possibly outputting a defective sound signal such as noise, and thus, the user located at the personalized sound zone position (i.e., the driver's seat position) may feel uncomfortable listening to the sound source.

As illustrated in FIG. 1, the forming system for a personalized sound zone of the present invention may appropriately control sound sources output from the plurality of speakers so that only a specific sound source may be transferred according to positions of a listener in the closed space, thus forming a desired number of personalized sound zones at desired positions. To this end, the forming system for a personalized sound zone may include a sound source generating unit supplying a plurality of sound sources, a sound source output unit including a plurality of speakers; and a controller calculating a control filter to form a personalized sound zone when a sound source supplied from the sound source generating unit is output to the sound source output unit. Here, in the present invention, the control filter calculated by the controller is calculated to reflect frequency characteristics of the individual speakers, thus solving the problem as described above.

Figure 2:
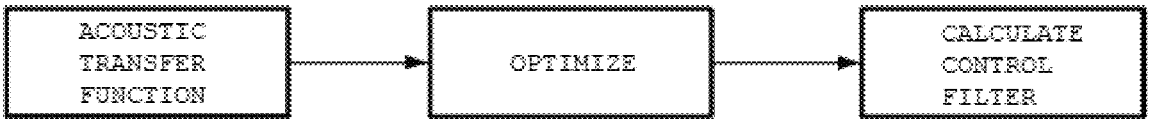
FIG. 2 is a block diagram for explaining a method of calculating a control filter for forming a personalized sound zone.

FIG. 2 is a block diagram for explaining a method of calculating a control filter for forming a personalized sound zone. In the related art, an acoustic transfer function is configured in an acoustic space and optimized to calculate a control filter, thus transferring different sound sources to the individual personalized sound zones.

As can be seen from FIG. 2, in the related art control filter calculation method for forming a personalized sound zone, the characteristics of each of a plurality of speakers are not considered. However, as described above, it is well known that speakers are generally formed and provided to advantageously output a sound source of a certain selected frequency band such as a tweeter for a high range, a mid-looper or a full-range for a mid-range, and a sub-woofer for a low range. Thus, in case where the sound source output unit includes a combination of a plurality of speakers having different frequency characteristics, if the sound source output unit is controlled by the related art method, all the speakers may be equally controlled, without considering the characteristics of the individual speakers, and thus, there is a high possibility that a personalized sound zone is not properly performed.

To solve the related art problem, in the forming method for a personalized sound zone of the present invention, the sound source output unit includes a combination of a plurality of speakers having different frequency characteristics and the controller calculates the control filter, which controls a sound source output from the sound source output unit, to reflect the characteristics of the individual speakers. In detail, the controller may be calculated to reflect a contribution of each frequency band of the individual speakers.

Figure 3:
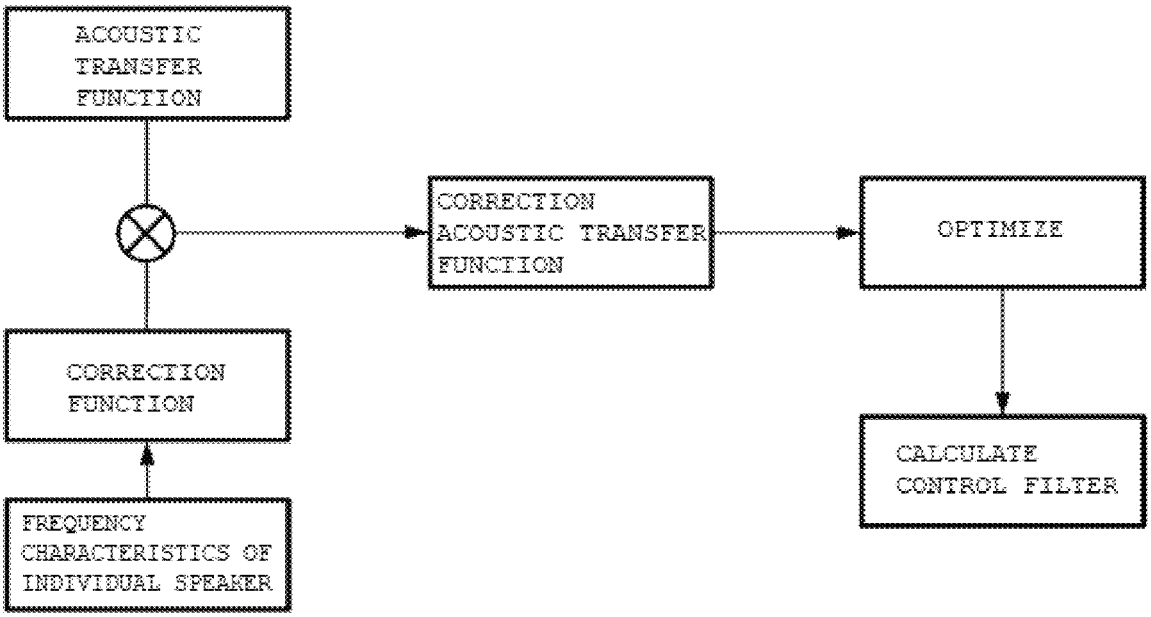
FIG. 3 is a block diagram for explaining a method of calculating a control filter according to an embodiment of the present invention.

FIG. 3 is a block diagram for explaining a method of calculating a control filter according to an embodiment of the present invention. According to the forming method for a personalized sound zone of the present invention, the characteristics of individual speakers, preferably, a correction function considering frequency characteristics of the individual speakers, is calculated and reflected in an acoustic transfer function to configure a correction acoustic transfer function, and the configured correction acoustic transfer function is optimized to calculate a control filter.

Figure 12:
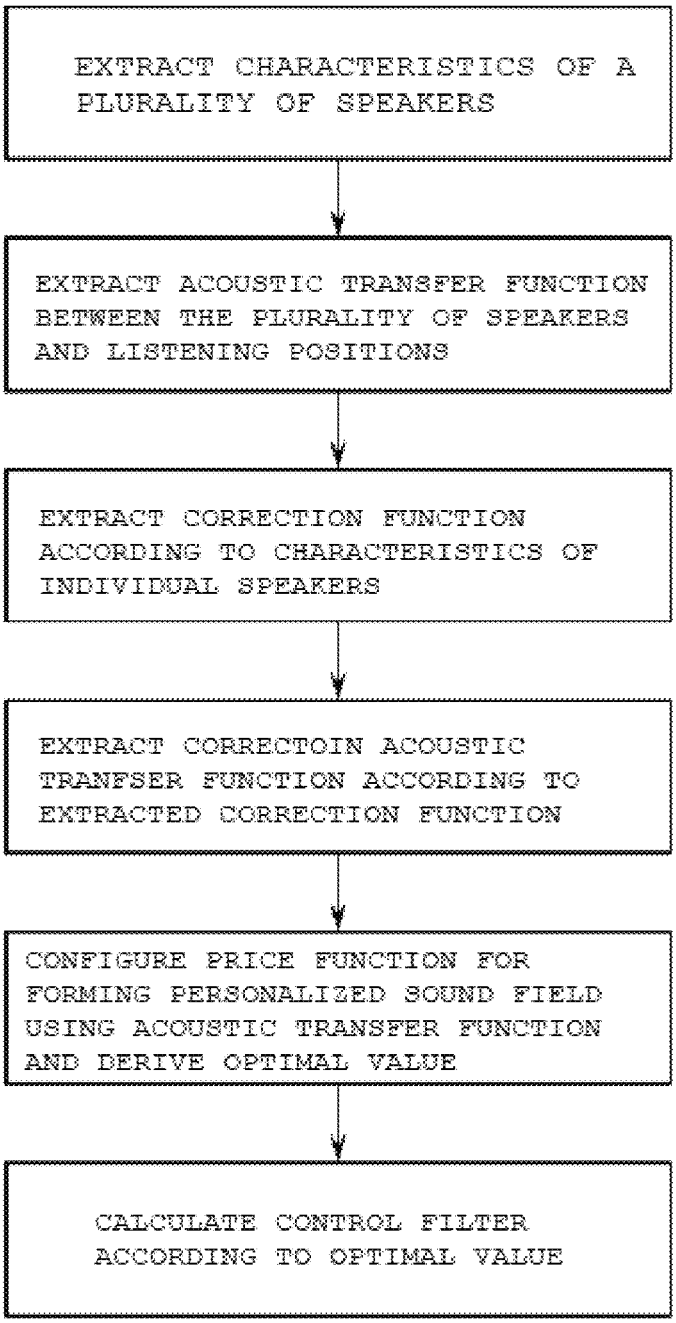
FIG. 12 is a flowchart of an embodiment of a forming method for a personalized sound zone of the present invention.

This will be described in detail by stages as follows. Referring to the flowchart of FIG. 12, the forming method for a personalized sound zone of the present invention is to form a mutually personalized sound zone for transmission of individual sound sources to a plurality of listening positions in a space as described above. First, characteristics (frequency characteristics) of the plurality of speakers arranged in the space are extracted, and an acoustic transfer function between the plurality of speakers arranged in the space and the listening positions is also extracted.

Next, the correction function is extracted according to the characteristics of the individual speakers. Here, the correction function may be calculated according to frequency characteristics of the individual speakers. Specifically, the correction function may be calculated according to a contribution of the individual speakers at each frequency band. Alternatively, after a weighting value for each frequency band set by an audio equalizer is received, the correction function may be calculated according to the input weighting value for each frequency band. In this case, the user may more actively participate in forming the personalized sound zone. Further, when the correction function is calculated, it is preferable to calculate a distance to a listening position where the personalized sound zone is formed with the plurality of speakers. In this case, the correction function is calculated according to a contribution of the individual speakers for each frequency band according to the distance to the listening position where the personalized sound zone is formed.

The correction acoustic transfer function is extracted according to the extracted correction function, a price function for forming the personalized sound zone is configured using the extracted acoustic transfer function, an optimal value is derived, and then, the control filter is calculated according to the derived optimal value.

As described above, according to the present invention, the frequency characteristics of the individual speakers are analyzed, and a control filter fitting the individual speakers is calculated according to a contribution at each frequency band to output a sound source. In a specific example, it is assumed that a certain sound source is output to a speaker A for a full-range (for a mid-range) and a speaker B which is a subwoofer (for a low range). When a personalized sound zone is formed by the related art method, the speakers A and B output sound sources through the same control filter. For example, when the sound source itself is a sound source having a large number of mid-ranges, various problems arise in the speaker B. That is, since the speaker B contributes relatively less to formation of the personalized sound zone substantially, an unnecessary calculation load is consumed to control the speaker B. In addition, the speaker B is a device optimized for outputting a low-range sound source, but since the speaker B is controlled equally with the speaker A for a mid-range, excessive forced excitation occurs in the speaker B, increasing a numerical error and a device load. However, in the present invention, since a control filter fitting the individual speakers is calculated to output the sound source, in the case of the above-mentioned example, the speaker A having a high contribution in the mid-range mainly performs outputting and unnecessary forced excitation does not occur in the speaker B, and thus, efficiency and performance of forming the personalized sound zone may be improved significantly.

Hereinafter, the principle of extracting a correction function will be described in more detail theoretically.

The acoustic brightness contrast control refers to an active source control method of forming a high sound pressure in a space (acoustically bright space (zone)) and forming a low sound pressure in another space (acoustically dark space (zone)) by maximizing a ratio of an average acoustic position energy density of the two spaces defined in the entire control space by controlling a plurality of sound sources. A personalized sound zone may be formed using the acoustic brightness contrast control principle.

Figure 11:
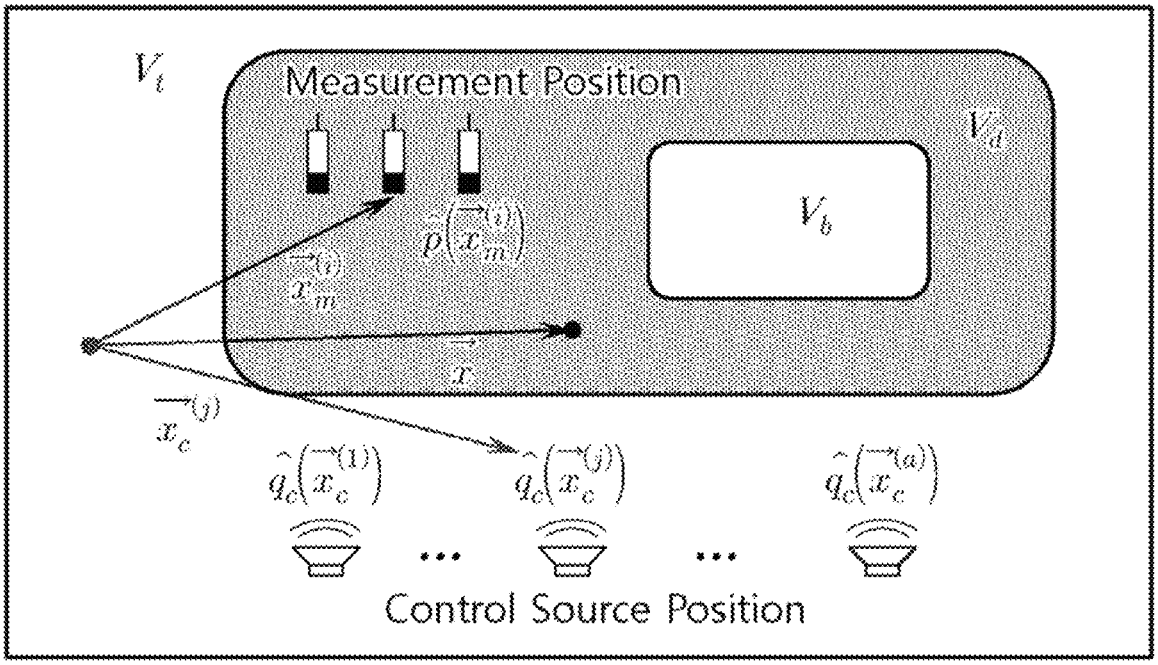
FIG. 11 is a diagram for explaining the principle of forming a personalized sound zone of the present invention.

In order to consider a relationship between a sound source and a sound field, a system including a number of sound sources and b number of measurement points having certain boundary conditions as illustrated in FIG. 11 is assumed. A magnitude of a complex sound pressure formed at a certain observation point in space by a sound source is $\hat{p}(\vec{x})$. Here, the symbol '^' means that a physical quantity has a complex constant value. Also, a complex volume velocity at each position $\vec{x}_c^{(j)}$ of the sound source (that is, the position of the individual speaker) is $\hat{q}_c^{(j)}$. $V_t$ denotes the entire control space, $V_b$ denotes an acoustically bright space, and $V_d$ denotes an acoustically dark space.

In case where each sound source radiates a sound wave at a complex volume velocity $\hat{q}_c^{(j)}$ at each position $\vec{x}_c^{(j)}$, a magnitude $\hat{p}(\vec{x})$ of a complex sound pressure formed at a certain point $\vec{x}$ in a space may be expressed by Equation 1 below using a green function $\hat{G}(\vec{x}\,|\,\vec{x}_c^{(j)})$.

$$\hat{p}(\vec{x}) = \sum_{j=1}^{b} \hat{G}(\vec{x}\,|\,\vec{x}_c^{(j)})\hat{q}_c(\vec{x}_c^{(j)}) \quad \text{(Equation 1)}$$

A variable $e_b$ representing average acoustic position energy density in the acoustically bright space having a volume $V_b$ may be defined as expressed by Equation 2 below. In Equation 2, the superscript "*" denotes a complex conjugate.

$$e_b = \frac{1}{V_b}\int_{V_b} \hat{p}(\vec{x})^* \hat{p}(\vec{x})dV \quad \text{(Equation 2)}$$

When Equation 1 is substituted to Equation 2, a matrix representing a spatial correlation between the sound fields formed by the respective sound sources may be defined as expressed by Equation 3 below, which is called a spatial correlation matrix $$R_b = \frac{1}{V_b}\int_{V_b} \hat{G}(\vec{x}\,|\,\vec{x}_c)^H \hat{G}(\vec{x}\,|\,\vec{x}_c)dV \quad \text{(Equation 3)}$$

Using the spatial correlation matrix defined in Equation 3, the average acoustic position energy density of the acoustically bright space and dark space defined in FIG. 11 may be simply expressed by Equation 4 below.

$$e_b = q_c^H R_b q_c, e_d = q_c^H R_d q_c \quad \text{(Equation 4)}$$

A function representing an average acoustic potential energy density ratio of the bright space and the dark space may be expressed by Equation 5 below, which is defined as acoustic contrast.

$$\mu = \frac{e_b}{e_d} = \frac{q_c^H R_b q_c}{q_c^H R_d q_c} \quad \text{(Equation 5)}$$

This problem may be summarized as an optimization problem without constraint conditions as illustrated in Equation 6 below.

$$\text{Maximize } J = q_c^H R_b q_c + \mu(J_0 - q_c^H R_d q_c) \quad \text{(Equation 6)}$$

Therefore, the problem of maximizing the brightness ratio of the bright space and the dark space is formulated as a problem of finding an optimal solution $q_{opt}$ maximizing the Rayleigh quotient μ of Equation 6. In this case, the optimization problem of Equation 6 is the same as the problem of finding an eigenvector corresponding to a maximum eigenvalue $\mu_{max}$ of a generalized eigenvalue problem as expressed by Equation 7 below.

$$(R_d^{-1} R_b) q_c = \mu q_c \quad \text{(Equation 7)}$$

The eigenvector of the maximum eigenvalue obtained therethrough means a control input inputted to each sound source, whereby the acoustically bright space and the dark space are formed on the entire control space.

An actual output signal is generated by applying the eigenvector of the maximum eigenvalue calculated in Equation 7 to the sound source, which may be expressed by Equation 8 below.

$$q_{control} = \Lambda q_c \quad \text{(Equation 8)}$$

Here, the position $\vec{x}_c^{(j)}$ of the individual speaker is considered in the process of obtaining Equation 8, which is a distance to a listening position where a personalized sound zone is formed with the plurality of speakers. In addition, a correction function is calculated in consideration of a contribution of each speaker at each frequency band, that is, speaker characteristics. In an example of calculation of a correction function considering the speaker characteristics, if a sound pressure level difference of dark zone before and after control is smaller than a specific value, it is determined that there is no contribution and a correction value may be set to 0. That is, when the sound pressures in the dark zone before and after the control are respectively defined as $p_{d,before}$, $p_{d,after}$, the sound pressures may be expressed by Equations 9a and 9b on the basis of Equations 3 and 4.

$$p_{d,before} = R_d q_c, \quad \text{(Equation 9a)}$$

$$p_{d,after} = R_d q_{c,control} R_d \Lambda q_c \quad \text{(Equation 9b)}$$

Here, the sound pressure level difference before and after the control may be expressed by Equation 10 below.

$$\Delta p = p_{d,before} - p_{d,after} = R_d(I - \Lambda) q_c \equiv W q_c \quad \text{(Equation 10)}$$

Here, W is defined as a reference function (matrix) for extracting a correction function.

Here, a correction function $W_d$ may be defined as expressed by Equation 11 below, for example.

$$W_{d,ij} = \begin{cases} 1 & \text{for } W_{ij} \geq C \\ 0 & \text{for } W_{ij} < C \end{cases} \quad \text{(Equation 11)}$$

Here, based on C as a reference value, for example, if the difference before and after the control is less than 3 dB, it is determined that there is no control effect and a value 0 is allocated. If the difference is 3 dB or greater, value 1 is allocated and C is defined as 2 corresponding to 3 dB. Here, C may be determined to be different depending on the experience of an engineer. That is, the correction function is calculated according to a contribution of each speaker at each frequency band. Using the above correction function, a sound source signal after control in Equation 8 is applied as expressed by Equation 12 below.

$$q_{control} = W_d \Delta q_c \quad \text{(Equation 12)}$$

The definition of the correction function as in Equation 11 is merely an example and the present invention is not limited thereto. The correction function may be defined according to any other method appropriately to optimally operate the individual speakers according to frequency characteristics thereof.

Figure 4:
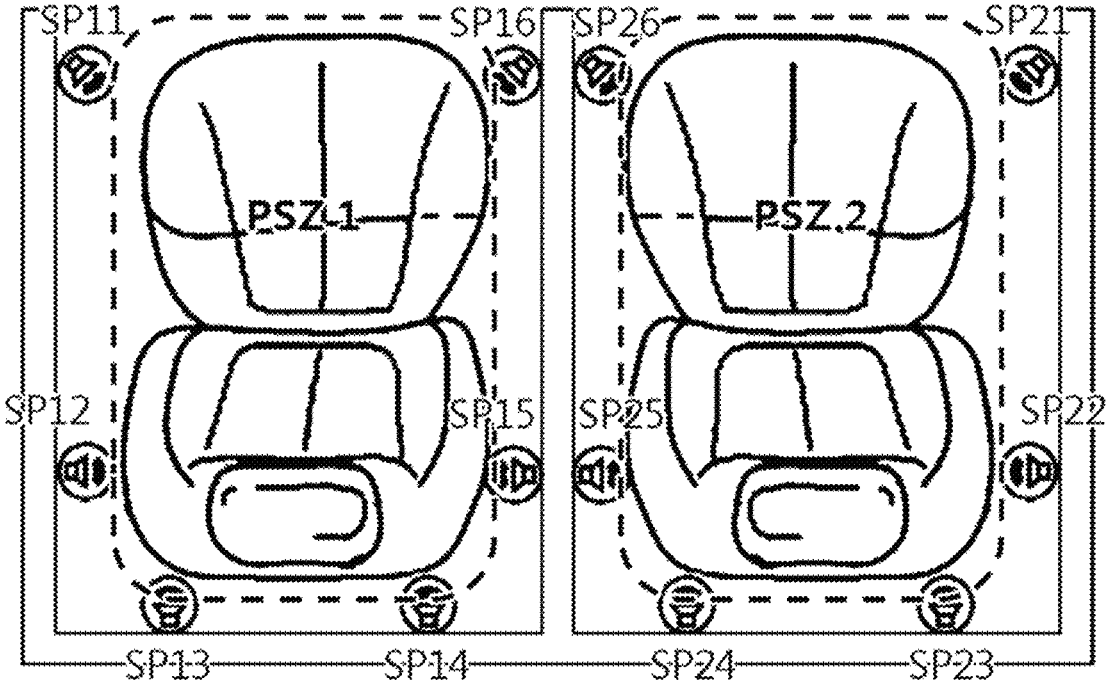
FIG. 4 is a schematic view illustrating a testing apparatus for explaining a forming method for a personalized sound zone according to an embodiment of the present invention.

FIG. 4 is a schematic view of a testing apparatus for explaining a forming method for a personalized sound zone according to an embodiment of the present invention. In a system simulating vehicle seats, personalized sound zones were formed using six speakers per seat, i.e., a total of 12 same speakers, and a sound field forming effect according to speaker characteristics were tested and analyzed. As illustrated in FIG. 4, a testing apparatus was configured by arranging six speakers SP11, SP16 to surround a left seat to form a personalized sound zone PSZ1 and six speakers SP21, SP26 to surround a right seat to form a personalized sound zone PSZ2. Hereinafter, before explaining test analysis results using the testing apparatus of FIG. 4, the related art forming method for a personalized sound zone and various embodiments of a forming method for a personalized sound zone of the present invention will be compared and described.

Figure 5:
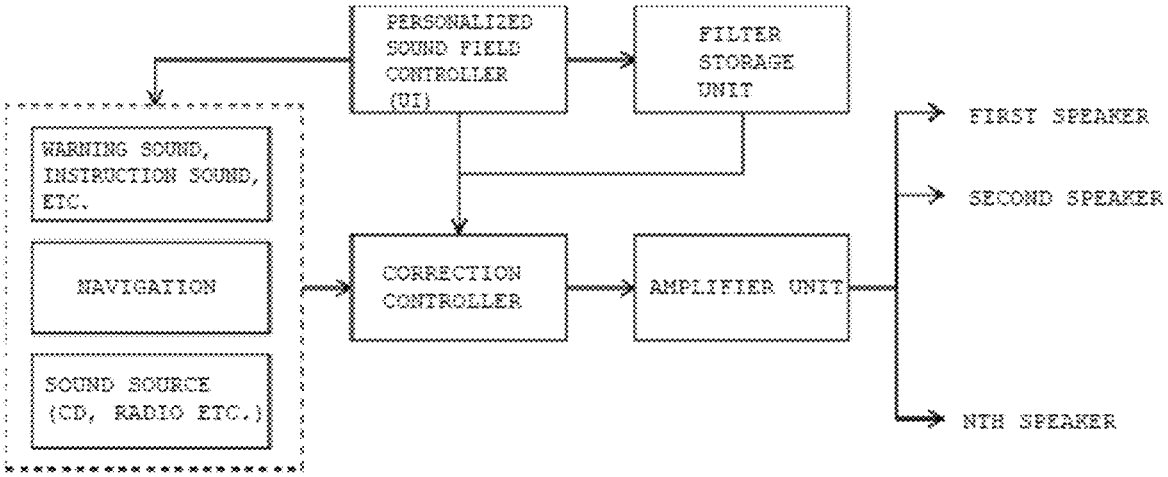
FIG. 5 is a block diagram for explaining the related art forming method for a personalized sound zone.

FIG. 5 is a block diagram for explaining the related art forming method for a personalized sound zone. In the related art, a UI of a personalized sound zone controller is operated by a user, a control filter stored in a filter storage unit is selected according to whether a sound source is a warning sound, an instruction sound, a navigation sound, or a sound source of a CD, a radio set, or the like, and a correction controller forms a control sound source required for forming a personalized sound zone by reflecting the selected control filter in the sound source and transfers the formed control sound source to the individual speakers through an amplifier unit to form a personalized sound zone providing different sound sources to individual spaces. However, the related art forming method for a personalized sound zone has a problem that the personalized sound zone is not properly formed as described above because each speaker characteristics are not reflected.

Figure 13:
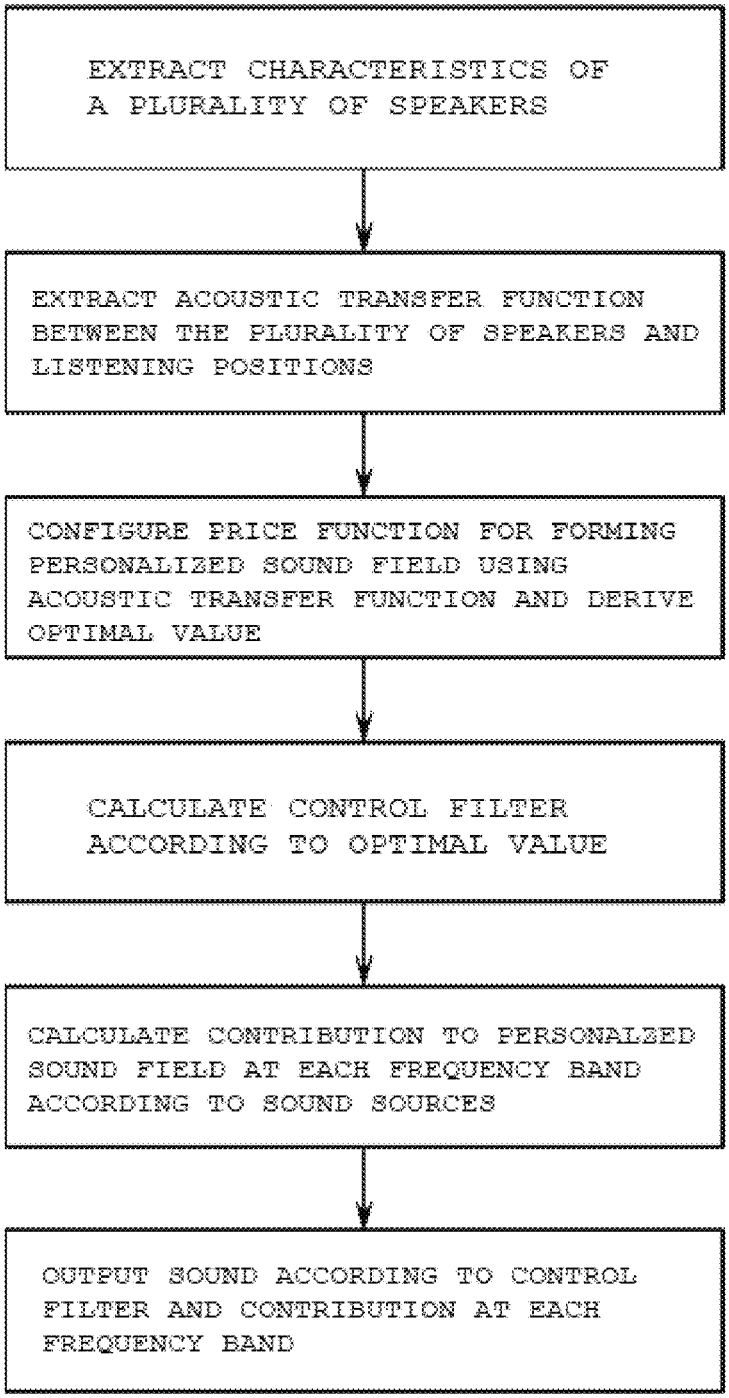
FIG. 13 is a flowchart of another embodiment of a forming method for a personalized sound zone of the present invention.

In the present invention, a personalized sound zone may be formed smoothly and properly by performing control according to frequency characteristics of the individual speakers. Here, as described above, in order to form the personalized sound zone, speaker characteristics may be extracted, an acoustic transfer function between speakers and listening positions may be extracted, a correction function may be extracted according to the speaker characteristics, the acoustic transfer function may be corrected using the extracted correction function, the control filter may be calculated using the corrected acoustic transfer function, and sound may be output according to the control filter (See the flowchart of FIG. 12). Alternatively, as illustrated in the flowchart of FIG. 13, instead of calculating the control filter by correcting the acoustic transfer function, the control filter may be calculated using the acoustic transfer function as is without correction, and sound may be output in further consideration of a contribution of sound sources at each frequency band. That is, speaker characteristics are extracted and the acoustic transfer function between the speakers and the listening positions may be extracted like the case of FIG. 12, but the control filter may be calculated using the extracted acoustic transfer function as is without correction and sound may be output according to a contribution of the control filter and the sound sources at each frequency band.

This will be described in detail by stages as follows. Referring to FIG. 13, first, the characteristics (frequency characteristics) of the plurality of speakers arranged in the space are extracted and the acoustic transfer function between the plurality of speakers arranged in the space and the listening positions is extracted, like the case described above.

Next, a price function for forming a personalized sound zone is configured using the extracted acoustic transfer function, an optimal value is derived, and a control filter is calculated according to the derived optimal value. In the above description, the operation of correcting the acoustic transfer function using the correction function before calculation of the control filter is performed, but in this case, the extracted acoustic transfer function is used as is.

Thereafter, a contribution of the sound sources to the personalized sound zone at each frequency band is calculated. In a specific example, a frequency band having a high contribution to formation of a personalized sound zone and a frequency band having a low contribution may be separated according to sound sources. When the contribution of the sound sources at each frequency band is calculated, sound is output according to the contribution of the control filter and the sound sources at each frequency band calculated in the previous operation. In a specific example of the sound output operation, the calculated control filter may be applied at a frequency band having a high contribution and the control filter may not be applied at a frequency band having a low contribution.

Figure 6:
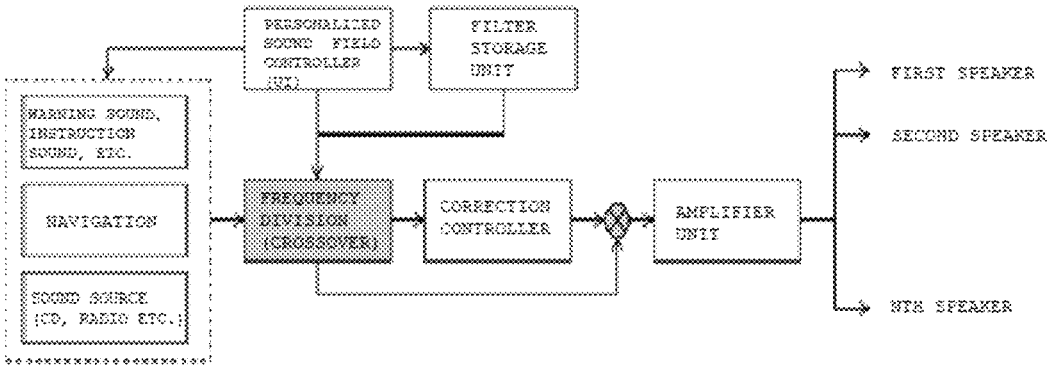
FIG. 6 is a block diagram illustrating a forming method for a personalized sound zone according to an embodiment of the present invention.

Here, in the operation of outputting sound, a sound source signal to which the control filter is applied and a sound source signal to which the control filter is not applied according to a contribution may be added to be output. FIG. 6 is a block diagram for explaining a forming method for a personalized sound zone implemented in this manner. Unlike the related art, the forming method for a personalized sound zone according to an embodiment of the present invention further includes a frequency distributor distributing a frequency according to a contribution and a synthesizing unit for synthesizing the frequency in order to provide specific directionality to a frequency band naturally available for sound separation between seats although a filter for forming a personalized sound zone is not applied due to a sound pressure difference naturally generated for each frequency band, that is, due to a sound pressure attenuation influence according to distances, rather than controlling it. According to the forming method for a personalized sound zone of the present invention, a personalized sound zone may be efficiently formed, as compared with the case where high-frequency speakers with respect to each seat is disposed in a frequency zone not effective in filter application and a filter is applied for a band having a large additional effect by the other remaining filter as conventionally.

Alternatively, in the operation of outputting sound, the calculated control filter is applied to a sound source of a frequency band having a high contribution and the corresponding sound source may be output to the speakers through an amplifier, and the control filter is not applied to a sound source of a frequency band having a low contribution and the corresponding sound source may be directly output to the speakers without passing through the amplifier.

Figure 7:
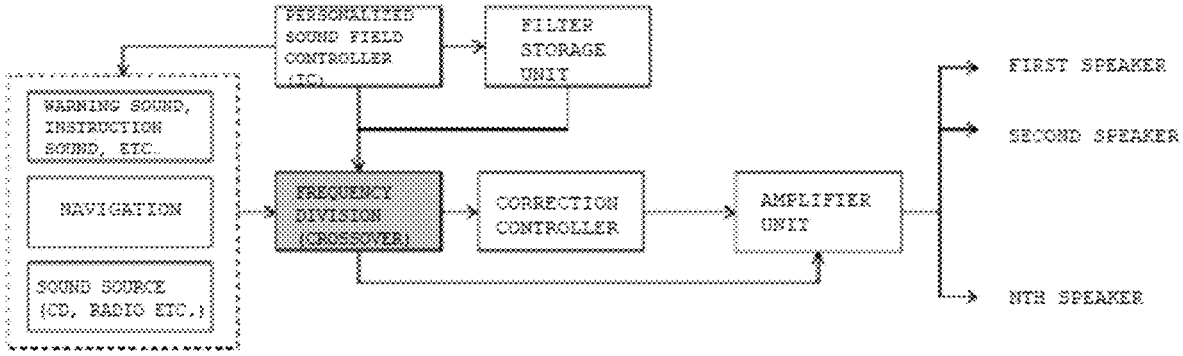
FIG. 7 is a block diagram for explaining a forming method for a personalized sound zone according to another embodiment of the present invention.

FIG. 7 is a block diagram for explaining a forming method for a personalized sound zone implemented in this manner. Sound sources are separated according to frequency bands without a separate synthesizing unit, and the separated sound sources are immediately transmitted to speaker channels according to corresponding frequencies to drive speakers, thus further enhancing efficiency.

Figure 8:
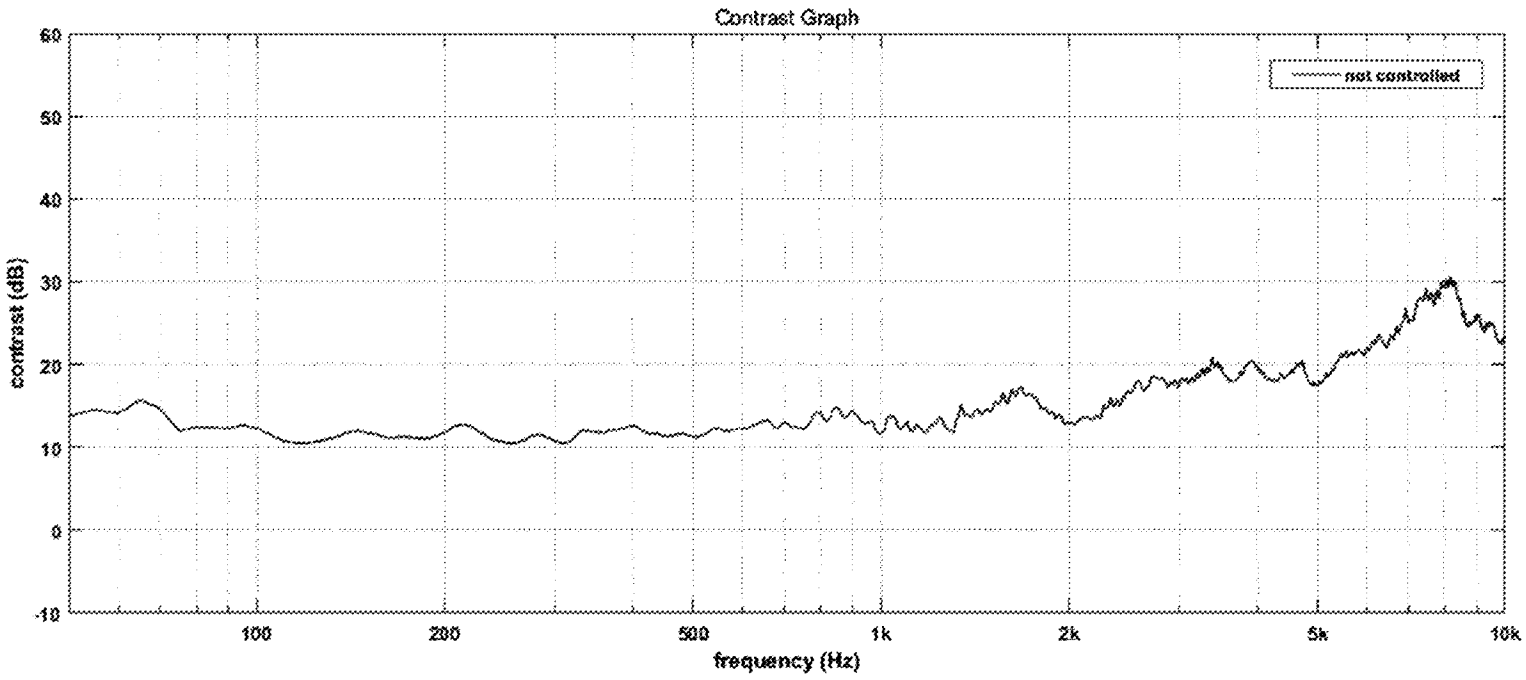
FIG. 8 is a diagram for explaining an influence of a speaker on formation of a sound field according to distances.

FIG. 8 is a diagram for explaining an effect of a speaker on formation of a sound field according to distances, in which it can be seen that a difference in sound pressure level naturally generated due to distance attenuation although a personalized sound zone control is not performed. Referring to FIG. 8, a sound pressure level difference of 20 dB or greater occurs due to natural distance attenuation although personalized sound zone control is not performed in the frequency band of 3 kHz or higher. In the case of the interior of a vehicle, there may be an influence of a reflected sound, but since it is a sound already attenuated by more than 20 dB, the sound will not affect up to 3 dB or greater although it is reflected.

Figure 9A:
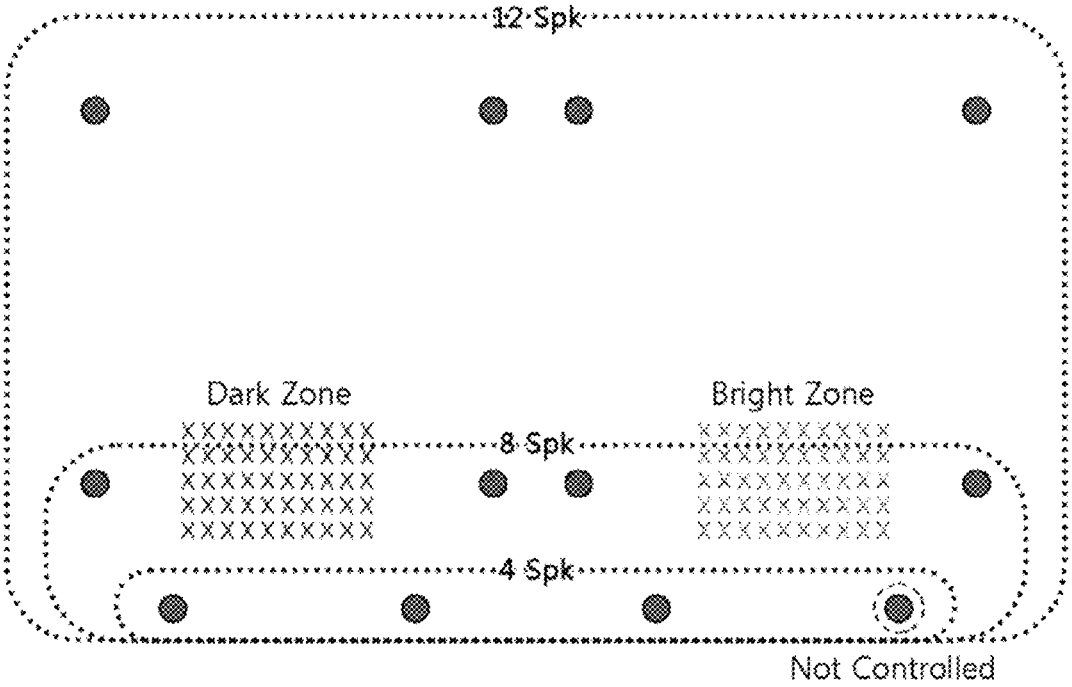
FIGS. 9A and 9B are diagrams for explaining a testing method for explaining a forming method for a personalized sound zone according to the number of control speakers.
Figure 9B:
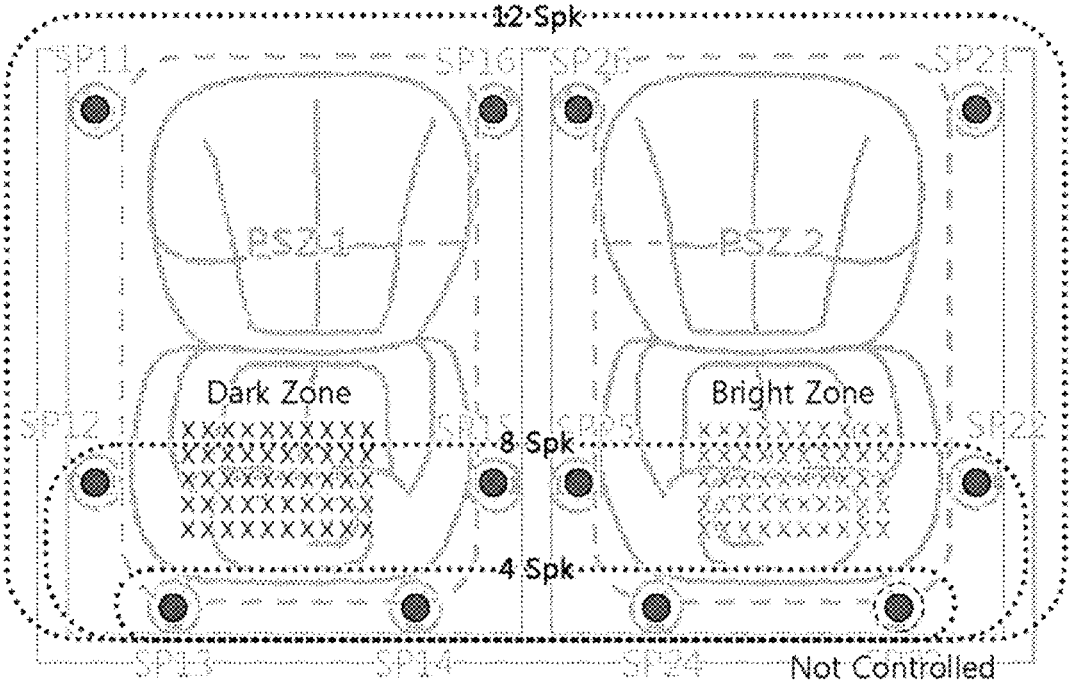

FIGS. 9A and 9B are diagrams for explaining a testing method for explaining a forming method for a personalized sound zone according to the number of control speakers. FIG. 9A simply illustrates cases of controlling using 4, 8, and 12 speakers, and FIG. 9B illustrates FIG. 9A and the testing apparatus illustrated in FIG. 4 in an overlapping manner. Referring to FIG. 9B, in the case of using 4 speakers, SP13, SP14, SP23, and SP24 in the testing apparatus of FIG. 4 are used. In the case of using 8 speakers, SP12, SP15, SP22, and SP25 are further used in addition to SP13 to SP24, and in the case of using 12 speakers, all the speakers of SP11 to SP26 are used.

Figure 10:
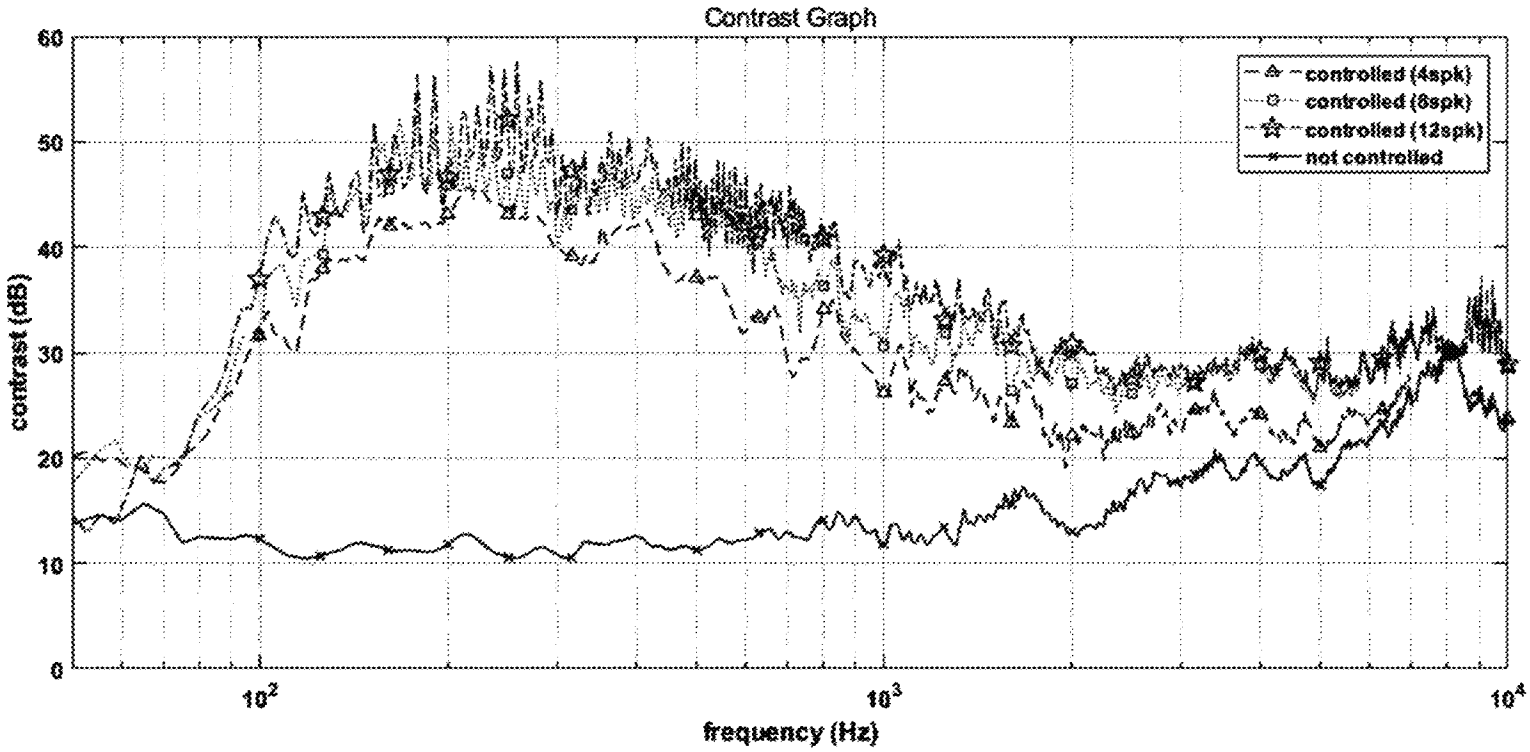
FIG. 10 is a graph illustrating a difference in sound pressure level between seats when a personalized sound zone is formed according to the number of control speakers.

FIG. 10 is a graph showing a difference in sound pressure level between seats when a personalized sound zone is formed according to the number of control speakers. Referring to FIGS. 9 and 10, it can be seen that there is a difference in the sound pressure level between regions and seats affecting formation of a personalized sound zone according to the number of control speakers.

Through the above-described solution, the forming method and the forming system for a personalized sound zone of the present invention may reduce noise generation according to a numerical error in forming the personalized sound zone and improve calculation efficiency by considering the acoustic characteristics of the individual speakers.

Further, the present invention has the effect of reducing the calculation amount of the control filter calculation by selecting whether to apply the filter according to a contribution at each frequency band.

Further, in consideration of the acoustic characteristics of the individual speakers, the present invention has an effect of reducing an error in calculating the control filter by calculating the control filter by reflecting a set equalizer value adjusted by the user.

What is claimed is:

1. A personalized sound zone forming method for forming a personalized sound zone to transfer individual sound sources to a plurality of listening positions in a space, the personalized sound zone forming method comprising:

extracting characteristics of a plurality of speakers arranged in a space;

extracting an acoustic transfer function between the plurality of speakers arranged in the space and the plurality of listening positions;

extracting a correction function according to the characteristics of the individual speakers;

extracting a correction acoustic transfer function according to the extracted correction function;

configuring a price function for forming a personalized sound zone using the extracted acoustic transfer function and deriving an optimal value; and calculating a control filter according to the derived optimal value;

receiving a weighting value for each frequency band set through an audio equalizer, wherein, in the extracting of a correction function, the correction function is calculated according to the frequency characteristics of the individual speakers and the weighting value for each frequency band set through the audio equalizer.

2. The personalized sound zone forming method of claim 1, wherein the correction function is calculated according to a contribution of the individual speakers at each frequency band.

3. The personalized sound zone forming method of claim 1, wherein the extracting of a correction function further includes:

calculating a distance to the listening positions where a personalized sound zone is formed with the plurality of speakers.

4. The personalized sound zone forming method of claim 3, wherein the correction function is calculated according to a contribution of the individual speakers at each frequency band according to the listening positions where a personalized sound zone is formed.

5. A personalized sound zone forming method for forming a personalized sound zone to transfer individual sound sources to a plurality of listening positions in a space, the personalized sound zone forming method comprising:

extracting characteristics of a plurality of speakers arranged in a space;

extracting an acoustic transfer function between the plurality of speakers arranged in the space and the plurality of listening positions;

configuring a price function for forming a personalized sound zone using the extracted acoustic transfer function and deriving an optimal value;

calculating a control filter according to the derived optimal value;

calculating a contribution to a personalized sound zone at each frequency band according to sound sources; and outputting sound according to the calculated control filter and the contribution of the sound sources at each frequency band;

wherein, in the calculating of a contribution at each frequency band, a frequency band having a high contribution and a frequency band having a low contribution in forming a personalized sound zone are separated according to the sound sources, and in the outputting of sound, the calculated control filter is applied to the frequency band having the high contribution and is not applied to the frequency band having the low contribution.

6. The personalized sound zone forming method of claim 5, wherein, in the outputting of sound, a sound source signal to which the control filter is applied and a sound source signal to which the control filter is not applied according to the contribution are added to be output.

7. The personalized sound zone forming method of claim 5, wherein, in the outputting of sound, the sound source of the frequency band having the high contribution is output to the speaker through an amplifier after the calculated control filter is applied thereto, and the sound source of the frequency band having the low contribution is directly output to the speaker, without applying the control filter thereto and without passing through the amplifier.

8. A personalized sound zone forming system for forming a personalized sound zone to supply different sound sources to a plurality of listening positions in a space, the personalized sound zone forming system comprising:

a sound source generating unit supplying a plurality of sound sources;

a controller calculating a control filter for forming a personalized sound zone; and a sound source output unit outputting a sound source to a personalized sound zone, wherein the sound source output unit includes a plurality of speakers and the control filter is calculated to reflect characteristics of the individual speakers; and an audio equalizer setting different weighting values for each frequency band, wherein the control filter is calculated according to frequency characteristics of the individual speakers and the weighting values for each frequency band set through the audio equalizer.

9. The personalized sound zone forming system of claim 8, wherein the sound source output unit includes a combination of a plurality of speakers having different frequency characteristics, and the control filter is calculated to reflect the characteristics of the individual speakers.

10. The personalized sound zone forming system of claim 9, wherein the control filter is calculated to reflect the contribution of the individual speakers at each frequency band.

11. The personalized sound zone forming system of claim 8, wherein the control filter is calculated to reflect the contribution of the individual speakers at each frequency band with respect to a distance to the listening positions where a personalized sound zone is formed with the plurality of speakers and a distance to the listening positions where the personalized sound zone is formed.

12. The personalized sound zone forming system of claim 10, wherein the controller separates a frequency band having a high contribution and a frequency band having a low contribution in forming a personalized sound zone according to the sound sources, and applies the calculated control filter to the frequency band having the high contribution and does not apply the control filter to the frequency band having the low contribution.

13. The personalized sound zone forming system of claim 11, wherein the sound source output unit adds a sound source signal to which the control filter is applied and a sound source signal to which the control filter is not applied according to the contribution, and outputs the same.

14. The personalized sound zone forming system of claim 11, wherein the sound source output unit outputs the sound source of the frequency band having the high contribution to the speaker through an amplifier after applying the calculated control filter thereto, and directly outputs the sound source of the frequency band having the low contribution to the speaker, without applying the control filter thereto and without passing through the amplifier.

* * * * *